United States Patent [19]

Anderson

[11] 4,339,235

[45] Jul. 13, 1982

[54] METHODS AND COMPOSITIONS FOR BLEACHING OF MYCOLOGICAL STAIN

[75] Inventor: Richard C. Anderson, Burnsville, Minn.

[73] Assignee: Economics Laboratory, Inc., St. Paul, Minn.

[21] Appl. No.: 100,736

[22] Filed: Dec. 6, 1979

[51] Int. Cl.[3] ..... D06L 3/06; C11D 3/395; C11D 7/54

[52] U.S. Cl. ..... 8/108 A; 252/95; 252/99; 252/186.21; 252/186.37; 252/187.25

[58] Field of Search ..... 252/187 H; 8/108 A; 259/95, 99; 424/149

[56] References Cited

U.S. PATENT DOCUMENTS

| | | | |
|---|---|---|---|
| 1,834,210 | 12/1931 | Horshmen | 252/187 H |
| 1,834,783 | 12/1931 | Johnson | 252/187 H |
| 1,937,229 | 11/1933 | Kantorowicz | 424/149 |
| 3,843,548 | 10/1974 | Jones | 424/149 |
| 3,951,834 | 4/1976 | Jayawant | 252/99 |
| 3,998,751 | 12/1976 | Murray | 252/187 H |
| 4,011,172 | 3/1977 | Marsan et al. | 252/187 H |
| 4,017,411 | 4/1977 | Dieht | 252/187 H |

OTHER PUBLICATIONS

X-14, Well Known Commercial Formulation of Calcium Hypochlorite, Sodium Hypochlorite, Sodium Carbonates.

Cab-O-Sil-, Properties and Functions, Cabot Corporation.

*Primary Examiner*—Irwin Gluck

*Attorney, Agent, or Firm*—Grady J. Frenchick

[57] ABSTRACT

Methods and compositions for bleaching and removal of mycological stain are disclosed. The method includes the step of contacting the mycological stain with the composition which includes an improved thixotropic, hypohalite bleach having fumed silica therein. Unexpected potentiation of the composition with respect to bleaching of mycological stain is found.

5 Claims, No Drawings

METHODS AND COMPOSITIONS FOR BLEACHING OF MYCOLOGICAL STAIN

BACKGROUND OF THE INVENTION

This invention relates to the bleaching and removal of mycological stain, e.g., molds or mildew. More particularly, a novel composition and method are provided for the bleaching and removal of mycological stains such as those which grow in older buildings beneath wall coverings (such as wall paper) and in other areas of high humidity such as bathrooms.

For many years, various solutions have been used to remove mycological stains i.e., the discoloration produced by chromatophoric bodies in fungal growth. A particularly successful class of solutions for removal (i.e., the oxidative decolorization of objectionable brown or black color along with the cleavage of attachment and structure-providing bonds of the fungus) of such stains are aqueous solutions of hypohalite salts, particularly hypochlorite. Hypochlorite solutions, particularly sodium hypochlorite solutions, have been found to bleach mycological stain, i.e., to oxidize or remove color producing bodies, and make to such bodies easier to flush from the surfaces on which they have grown. While conventional hypohalite solutions do remove mycological stain at typical concentrations, such solutions suffer the drawbacks of being slow in bleaching the stain and of having a tendency to "run" when applied to vertical surfaces.

BRIEF SUMMARY OF THE INVENTION

The present invention provides a novel composition and method for bleaching of mycological stain which overcomes the problems associated with conventional bleach solutions. Compositions of the present invention have improved tenacity or "cling" to mycological stains, (particularly those on vertical surfaces) and exhibit an unexpected potentiation with respect to bleaching and removal of such stain.

Briefly, in one aspect the present invention provides a novel hypohalite bleach solution, the solution being novel by virtue of the presence of a particular thixotropy increasing material, viz., fumed silica.

More particularly, the present invention provides a method of bleaching mycological stain comprising the step of:

contacting the stain with an aqueous solution comprising (a) from about 70% to 99% by weight water (preferably at least 80% water);

(b) from about 0.5% to 10% by weight inorganic salt selected from the group consisting of alkali metal and alkaline earth metal hypochlorites and hypobromites or mixtures thereof;

(c) about 0.5% to 5% fumed silica; and optionally (d) sufficient base to significantly increase the stability of the bleach solution;

the composition contacting the stain a sufficient length of time to essentially remove all color therefrom; The present method further contemplates the optional step of flushing the bleached stain from the surface on which it grew, preferably with water.

The novel composition of the present invention is a hypohalite bleach solution having increased viscosity and which exhibits potentiation in the bleaching of mycological stain. The novel composition comprises:

(a) from 70–99% by weight water (preferably at least 80% water);

(b) from about 0.5% to 10% by weight salt selected from the group consisting of alkali metal and alkaline earth metal hypochlorites, hypobromites or mixtures thereof;

(c) about 0.5% to 5% fumed silica; and optionally (d) sufficient base to significantly increase the stability of the bleach solution;

DETAILED DESCRIPTION OF THE INVENTION

The present invention is based upon the discovery that the addition of fumed silica (e.g., "Cab-O-Sil") to a conventional aqueous sodium hypohalite bleach solution produces a dramatic potentiation (i.e., activity increase) of the solution with respect to bleaching and removal of mycological stains. Of course the viscosity of the bleach solution is also increased. Hence, the present invention provides an activated aqueous hypohalite bleach solution which has the additional advantage of having an improved, greater viscosity.

The present invention contemplates the use of alkali, metal or alkaline earth metal, (i.e., the Group IA and Group IIA metals of the periodic table of elements), hypochlorites, hypobromites, or mixtures to provide a solution which is capable of removing and/or destroying the chromataphoric bodies in mycological stain. Preferred alkali metals and alkaline earth metal hypohalites include those in which the cation is lithium, sodium, potassium, magnesium or calcium. Alkali metal or alkaline earth metal hypochlorites constitute a preferred class of bleaching salts. A particularly preferred hypohalite salt, for reasons of cost and its efficacy in the present invention is sodium hypochlorite. Sodium hypochlorite has been used to provide aqueous bleaching solutions which have been sold under various trade designations in the consumer market, such as "Clorox", commercially available from The Clorox Company, "Purex" commercially available from Purex Company and "HiLex" commercially available from the HiLex Company.

Generally speaking, in order to have a solution which bleaches mildew stain in a reasonable amount of time, it is necessary that the concentration of hypohalite in the solution be in the range of 0.5% to 10%, preferably 1% to 6% by weight. Conventionally, hypohalite solutions, particularly sodium hypochlorite solutions for household use, are sold at a maximum concentration of about 5.25% by weight. At hypohalite concentrations in excess of about 5.25% by weight, significant gas is liberated from the solution. For this reason Department of Transportation regulations require ventable caps when concentrations in excess of 5.25% hypohalite by weight are employed. As a practical matter, then, the upper limit for hypohalite, particularly hypochlorite, is 5.25% by weight. It will be appreciated, that this concentration of hypohalite is one of a freshly prepared solution. One skilled in the art is well aware of the fact that the actual concentration of hypohalite anion decreases with time. Without being limited to any particular theory, it is generally believed that the hypohalite ion disproportionates to halide (e.g., $Cl^-$ or $Br^-$) and halate (e.g., $ClO_3^-$) ions.

One skilled in the art will also appreciate that any hypohalite salt in an aqueous solution will dissociate to hypohalite ions (e.g., $XO^-$ where X is a halogen) and alkali metal or alkaline earth metal cations. Hence, at any given instant there may be essentially zero concentration of associated halite salt. It follows that the weight percentages of hypohalite salt expressed above would be those found if the dissociated anions and cations in solution were caused to associate, e.g., by quantitative removal of water.

The advantageous properties and the unexpected behavior of the present method and composition result from the addition to a conventional hypohalite bleach solution of 0.5% by weight to 5% by weight, preferably, (1.5% to 3.5% by weight), fumed silica (silicon dioxide). A particularly preferred fumed silica for use in the invention is sold under the trade name "Cab-O-Sil" commercially available from the Cabot Corporation.

Unexpectedly, it has been found that the addition of fumed silica to a conventional hypohalite bleach solution produces significant potentiation of the solution with respect to bleaching and removal of mycological stain. As will be described in the examples, a hypohalite bleach solution with fumed silica therein effectuates a very rapid (e.g., less than three minutes or preferably less than one minute) conversion of darkly colored mycological stain to essentially colorless, easily removed material. This behavior is to be contrasted with that of conventional bleach solutions in which bleaching and removal of mycological stain is significantly slower.

Of course the addition of fumed silica to a hypohalite solution has the added effect of increasing its viscosity. The increase in viscosity of the bleaching solution is important for those applications where the solution is to be applied to a vertical surface such as the walls of a house or a bathroom. In addition to increasing the activity of the solution with respect to bleaching of stains, the solution is physically held in more intimate contact therewith. Since the primary commercial advantage of the thixotropic bleach of this invention is its increased viscosity, for any particular application, the minimum amount of fumed silica which should be added is one which provides a product having the desired viscosity.

In order to provide a composition with a sufficiently long shelf life, i.e., six months, it is generally desirable for the solution to be slightly alkaline, e.g., 0.4 to 0.7 percent excess sodium hydroxide or sodium carbonate. This amount of excess alkalinity tends to provide a bleach solution having a pH in the range of 9–12. pH is the familiar reciprocal logarithm of the hydronium ion concentration well known to those skilled in the art. Generally speaking (as described below) sufficient excess alkalinity (for extended shelf life) remains when hypochlorite ion is generated from a sodium hydroxide solution.

Other materials optionally may be added to the present composition, such as surfactants, perfumes, etc. These materials can be added to the present composition to provide a commercial product having particular desired qualities. Such optional materials do not detract from the efficacy and unexpected behavior exhibited by the compositions of the present invention.

The preparation of the materials utilized in the present method may be generally summarized by saying that first, a hypochlorite solution is prepared, the solution preferably having a concentration of available chlorine in excess of about 9%. The percent of available chlorine is determined by the familiar iodometric titration with thiosulfate. Such hypochlorite solutions are generally prepared by sparging pressurized gaseous chlorine through sodium hydroxide solution. It has been found that the solution after addition of fumed silica has a pH in the range of about 9–12, when the aforementioned alkaline sodium hypochlorite is used to make the product.

Generally, it has been possible to add the desired amount of fumed silica directly to the hypochlorite solution while the solution is being stirred. After addition of the fumed silica, the solution must be allowed to age for up to about 20 minutes during which time the viscosity of the solution increases. It is theorized that some sort of association develops between the fumed silica and the constituents of the hypohalite solution. Further, it has been found possible to overmix the solution in which case improperly sized (for proper viscosity) aggregates are formed. The formation of such aggregates tends to reduce the viscosity of the solution and also to cause the fumed silica thixotrope to separate.

Hence, it is important that the mix time limitations and the order of adding the components of the solution be followed as illustrated in the foregoing examples which are intended to be illustrative and not limiting of the invention.

EXAMPLE 1

Illustrating the preparation of a fumed silica-containing laboratory-sized (1,000 gram) potentiated sodium hypochlorite bleach solution.

After it has been determined that the amount of active chlorine in the sodium hypochlorite solution is in excess of about 9% (using the thiosulfate active chlorine determination method), 580 g of the 9% hypochlorite solution is charged to a 1500 ml glass beaker. No bare metal surfaces are employed in the preparation of the solutions herein. A glass stirring rod (or a polymer coated metal rod) is employed to stir the solution as well as a "Lightnin" mixer when convenient. While agitating the solution, 25 g fumed silica "Cab-O-Sil" grade M-5 commercially available from Cabot Corporation is gradually added to the solution (over about 30 sec.). While the fumed silica is being added to the solution, the solution is visually examined for the formation of excessively large (or small) particles. As noted above, the formation of improperly sized aggregates is to be avoided as this detracts from the viscosity and homogeniety of the finished solution. A uniform, fairly narrow distribution of particle diameters will result if the addition steps are followed.

Lastly, 395 g water are added to the stirred beaker thus completing formulation of the mycological stain removing composition. At this point, the solution should be permitted to age for a period (with agitation) of about 20 minutes during which time the viscosity of the solution increases.

In order to get good adhesion to vertical surfaces of the finished bleaching composition, it is necessary that the composition have a fairly well defined viscosity. For example, the "Consistometer" commercially available from Conco Corporation is employed to test the viscosity of the finished solution. The viscosity measuring device employs two chambers on opposite ends of a precisely horizontal 24 cm tubular trough. The first chamber is fully charged with the material whose viscosity is to be tested. A small trap door in the base of the first chamber is opened and the contents thereof are permitted to flow into the trough. The rate at which the material traverses along the trough is directly dependent upon the viscosity (i.e., its resistance to flow) of the material. For example, it has been found that a viable, thixotropic (i.e., non-running) bleach solution should travel less than the entire 24 cm length of the trough during a 30 second time period. Preferred bleach solutions generally travel from 6 cm to 21 cm during the 30 second test period. It has been found, that lacking fumed silica, the hypohalite solution would traverse the entire 24 cm distance and drain into the second, receiving chamber in less than the 30 second period.

EXAMPLE 2

Illustrating the preparation of a 4200 pound (1900 kg) batch of the mycological stain removing solution.

A 500 gallon glass-lined reactor having stirring means is employed, to which there is added 2440 pounds (1100 kg) of approximately 9% active chlorine sodium hypochlorite solution. With moderate agitation, 100 pounds (45 kg) fumed silica ("Cab-O-Sil") is added at the vortex of the stirred hypochlorite solution over a time period of slightly less than 20 minutes. The fumed silica is added so as to maximize the opportunity for the mixer to completely disperse the silica in the solution. Immediately after completion of addition of silica, suitably-sized, representative aliquots of the mixed solution are removed from the top and the bottom of the reactor. These two aliquots are visually checked to determine whether the silica is dispersed to essentially the same extent in each. Once it has been determined (by visual examination of the aliquots) that the silica is homogeneously dispersed throughout the solution, (i.e., through the upper and lower portions as compared above) 200 gallons (750 liter) water are added to the stirred solution at the rate of about 10 gallons per minute (37.8 liter per minute). After completing addition of the water, the now completed solution is mixed for an additional five minutes and then is stored or poured into 55 gallon (210 liter) drums or other suitable container prior to use.

EXAMPLE 3

Illustrating the potentiation of the sodium hypohalite bleaching solution.

An *Aspergellius niger* mold such as that found on the underside of wall paper in older homes, was employed to test the present compositions and conventional bleaching compositions not having fumed silica therein. In each case, a 5.25% active chlorine sodium hypochlorite solution was employed, the only difference being that in one case an additional 2% "Cab-O-Sil" had been added to the solution. The *Aspergellius niger* to be tested was placed on a horizontal surface and one drop each of the two solutions was placed on the mildew. The treated mildew was then visually compared after one minute, three minutes and five minutes.

It is apparent from table 1, that the addition of the "Cab-O-Sil" to a conventional sodium hypochlorite solution very substantially increases the ability of that solution to bleach common mycological stain.

EXAMPLE 4

Illustrating the potentiation of hypochlorite solutions in which there are lesser amounts of available chlorine.

Water was added to a material prepared as described in example 1, to produce sodium hypochlorite solutions having 1%, 2%, 3% and 4% available chlorine and having 2% fumed silica ("Cab-O-Sil"). These fresh solutions were compared with a standard 5.25% available chlorine sodium hypochlorite solution in which there is no fumed silica. The comparison was visual as in example 3. In every case, even where there was approximately 5 times the amount of available chlorine in the conventional solution, the solutions having the fumed silica therein were found to more rapidly and more completely bleach the common mycological stain *Aspergillus niger.* Further, the bleaching of the stain effectuated by the materials of the present invention was so rapid as not to pass through an intermediate orange-yellow state characteristic of the conventional 5.25% available chlorine solution.

TABLE I

| | Visual Comparison of Treated *Aspergillus niger* | |
|---|---|---|
| Minutes | No "Cab-O-Sil" | With "Cab-O-Sil" |
| 1 | stain turning orange yellow, minimal bleaching action | bleaching of stain begun and proceeding rapidly lightening of the mildew stain |
| 3 | more yellowing of stain, little actual bleaching | bleaching essentially complete |
| 5 | essentially same as 3 minute, stain merely yellow to brown | bleaching essentially complete |

What is claimed is:

1. A method of bleaching mycological stain comprising the step of:

contacting the stain with an aqueous composition comprising (a) from about 70% to 99% by weight water;

(b) from about 0.5% to 10% by weight salt selected from the group consisting of alkali metal and alkaline earth metal hypochlorites, hypobromites, and mixtures thereof;

(c) about 0.5% to 5% by weight fumed silica;

(d) about 0% to 2.0% by weight base;

the composition contacting the stain a sufficient length of time to bleach essentially all color therefrom;

2. A method according to claim 1 which further comprises flushing the bleached stain with water.

3. A method according to claim 1 wherein the salt is sodium hypochlorite.

4. A method according to claim 1 wherein the composition bleaches essentially all color from said stain in less than three minutes.

5. A method according to claim 1 wherein the composition bleaches essentially all color from said stain in less than one minute.

* * * * *